US007008490B2

(12) United States Patent
Peker

(10) Patent No.: US 7,008,490 B2
(45) Date of Patent: Mar. 7, 2006

(54) METHOD OF IMPROVING BULK-SOLIDIFYING AMORPHOUS ALLOY COMPOSITIONS AND CAST ARTICLES MADE OF THE SAME

(75) Inventor: Atakan Peker, Aliso Viejo, CA (US)

(73) Assignee: Liquidmetal Technologies, Tampa, FL (US)

( * ) Notice: Subject to any disclaimer, the term of this patent is extended or adjusted under 35 U.S.C. 154(b) by 0 days.

(21) Appl. No.: 10/263,965

(22) Filed: Oct. 2, 2002

(65) Prior Publication Data

US 2003/0075246 A1 Apr. 24, 2003

Related U.S. Application Data

(60) Provisional application No. 60/327,175, filed on Oct. 3, 2001.

(51) Int. Cl.
*C22C 45/00* (2006.01)

(52) U.S. Cl. ..... 148/561; 148/403

(58) Field of Classification Search ..... 148/403, 148/561

See application file for complete search history.

(56) References Cited

U.S. PATENT DOCUMENTS 5,032,196 A 7/1991 Masumoto et al.
5,213,148 A 5/1993 Masumoto et al.
5,279,349 A 1/1994 Horimura
5,288,344 A 2/1994 Peker et al.
5,368,659 A 11/1994 Peker et al.
5,618,359 A 4/1997 Lin et al.
5,711,363 A 1/1998 Scruggs et al.
5,735,975 A 4/1998 Lin et al.
5,797,443 A 8/1998 Lin et al.
6,010,580 A 1/2000 Dandliker et al.
6,021,840 A 2/2000 Colvin
6,044,893 A 4/2000 Taniguchi et al.
6,258,183 B1 7/2001 Onuki et al.
6,620,264 B1 * 9/2003 Kundig et al. ..... 148/561

OTHER PUBLICATIONS

International Search Report for PCT/US02/31563; mailed Jan. 6, 2003 (4 pages).

* cited by examiner

*Primary Examiner*—George Wyszomierski
(74) *Attorney, Agent, or Firm*—Christie, Parker & Hale, LLP

(57) ABSTRACT

Improved bulk-solidifying amorphous alloy compositions and methods of making and casting such compositions are provided. The improved bulk-solidifying amorphous alloys are preferably subjected to a superheating treatment and subsequently are cast into articles with high elastic limit. The invention allows use of lower purity raw-materials, and as such effectively reduces the overall cost of the final articles. Furthermore, the invention provides for the casting of new alloys into shapes at lower cooling rates then is possible with the conventional bulk-solidifying amorphous alloys.

67 Claims, 3 Drawing Sheets

METHOD OF IMPROVING BULK-SOLIDIFYING AMORPHOUS ALLOY COMPOSITIONS AND CAST ARTICLES MADE OF THE SAME

CROSS-REFERENCE TO RELATED APPLICATION

This application claims priority on U.S. provisional application No. 60/327,175 filed on Oct. 3, 2001, the content of which is incorporated herein by reference.

FIELD OF INVENTION

The present invention is directed to an improved bulk-solidifying amorphous alloy composition, to methods of making such compositions, and to articles cast from such compositions.

BACKGROUND OF THE INVENTION

The term "bulk-solidifying amorphous alloys" refers to a family of amorphous alloys that may be cooled at rates of about 500 K/sec or less from their molten state to form objects having thicknesses of 1.0 mm or more while maintaining a substantially amorphous atomic structure. Bulk-solidifying amorphous alloys' ability to form objects having thicknesses of 1.0 mm or greater is a substantial improvement on conventional amorphous alloys, which are typically limited to articles having thicknesses of 0.020 mm, and which require cooling rates of $10^5$ K/sec or more. Bulk-solidifying amorphous alloys, when properly formed from the molten state at sufficiently fast cooling rates, have high elastic limit typically in the range of from 1.8% to 2.2%. Further, these amorphous alloys may show bending ductility ranging from a few percent in samples of 0.5 mm thick or more to as high as 100% as in the case of 0.02 mm thick melt spun ribbons.

Generally speaking, bulk-solidifying amorphous alloy compositions have been found around highly deep eutectics. Highly deep eutectics is generally characterized and quantified by a reduced glass transition temperature, Trg, and is defined by the ratio of glass transition temperature to the melting temperature (in units of Kelvin). Herein, the melting temperature is generally understood as associated to the eutectic temperature. Generally, a high Trg has been desired to obtain easier bulk-solidification of the amorphous alloys. This relationship has been generally supported by both the classical theory of nucleation and experimental observation as well. For example, a Trg of 0.6 is observed for critical cooling rates of 500 C/sec, and a Trg of 0.65 or more is observed for critical cooling rates of 10 C/sec or less.

U.S. Pat. Nos. 5,032,196; 5,288,344; 5,368,659; 5,618,359; and 5,735,975 (each of whose disclosures is incorporated by reference in its entirety) disclose such families of bulk solidifying amorphous alloys. In addition, cast articles of these alloys in the form of in-situ composites have also been disclosed.

The discovery of bulk-solidifying amorphous alloys and the discovery that these alloys can be cast into articles having substantial thicknesses allows for the possibility of incorporating these high elastic limit materials in bulk form for a wide variety of applications. As such, a practical and cost-effective method to produce articles of these alloys is desired, and particularly for those applications that require designs of intricate and precision shapes. It has been found that metal mold casting methods, such as high-pressure die-casting, can be used to cast these materials as these methods provide high cooling rates. For example, U.S. Pat. Nos. 5,213,148; 5,279,349; 5,711,363; 6,021,840; 6,044,893; and 6,258,183 (each of whose disclosures is incorporated by reference in its entirety) disclose methods to cast articles of amorphous alloys.

However, it has been discovered that the presence of incidental impurities, such as oxygen, (when they exist in the alloy above certain concentrations) can detrimentally increase the rate of nucleation of crystals from the undercooled melts of the bulk-solidifying amorphous alloys and accordingly increase the critical cooling rates of these materials substantially. For example, U.S. Pat. No. 5,797,443 discloses as a result of the presence of impurities, these alloys cannot be cast into the desired thick sections, and further teaches the necessity to control the level of oxygen impurities when casting bulk-solidifying amorphous alloys. One proposed method to control incidental impurities, such as oxygen, is to use higher purity raw materials and much more strictly control processing conditions. However, these steps substantially increase the cost of articles made of bulk-solidifying amorphous alloys.

Accordingly, a need exists for new bulk-solidifying amorphous alloy compositions and new methods to cast these alloys into articles inexpensively without the concerns raised by incidental impurities arising from both raw materials and processing environment.

SUMMARY OF THE INVENTION

The present invention is directed to improved bulk-solidifying amorphous alloy compositions having an additional alloying metal in the amorphous alloy mix.

In one such embodiment, lower purity raw-materials are utilized, and as such effectively reduce the overall cost of the final articles.

In another embodiment the invention is directed to an improved method of casting such improved bulk-solidifying amorphous alloy compositions including superheating the alloy composition and subsequently casting the superheated composition into articles with high elastic limit.

In one such embodiment, the invention includes casting the new alloy compositions into shapes at low cooling rates.

In still another embodiment, the invention is directed to an article cast from the improved bulk-solidifying amorphous alloy.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

The present invention is directed to improved bulk-solidifying amorphous alloy compositions having an additional alloying metal in the amorphous alloy mix and improved methods of forming such compositions.

Figure 1:
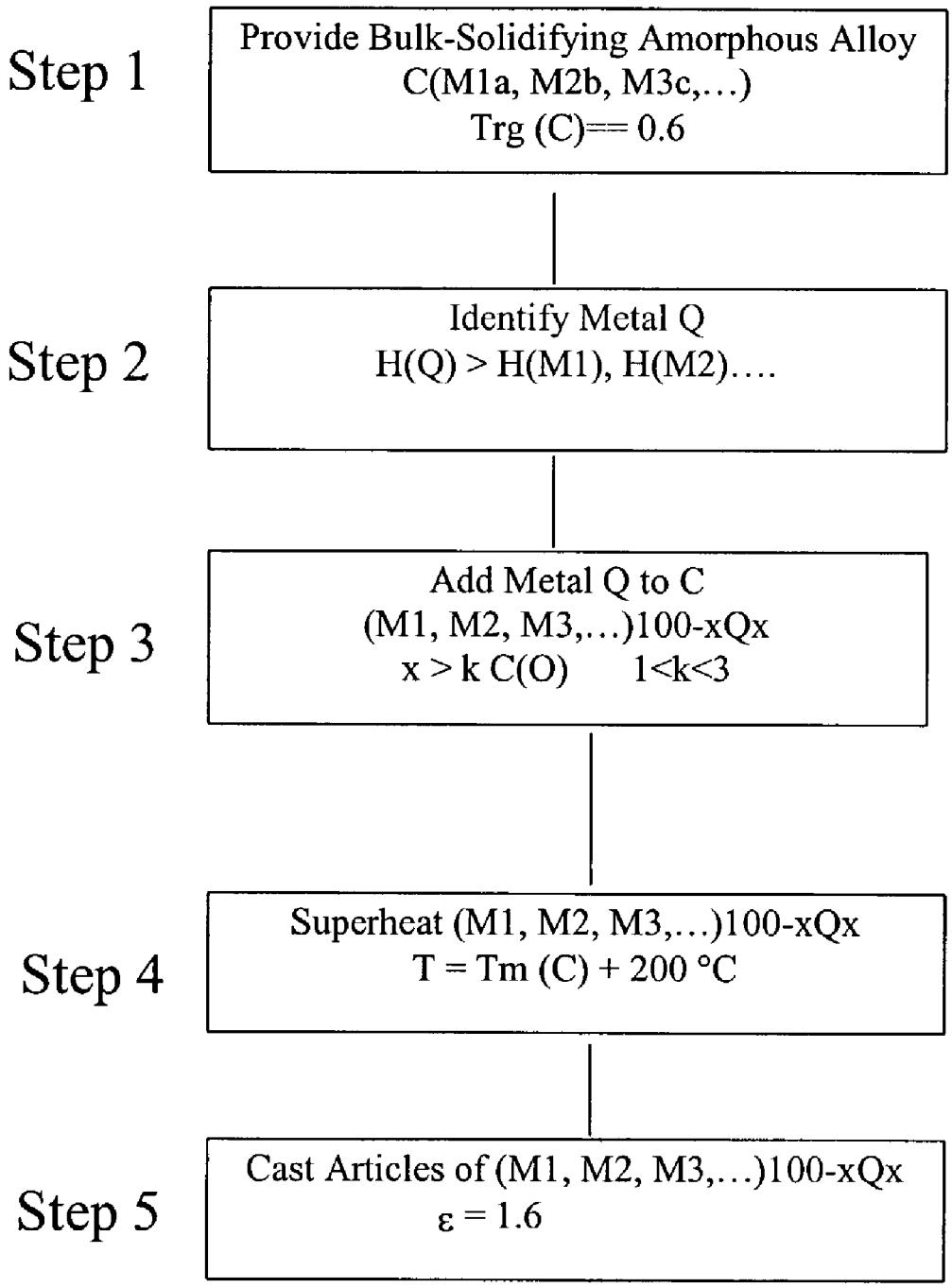
FIG. 1, is a flow diagram of a method of forming molded articles of bulk-solidifying amorphous alloys according to the present invention.

As shown in FIG. 1, in Step 1 of one embodiment, a bulk-solidifying amorphous alloy "C" with metal components M1, M2, M3, etc. having a ratio of glass transition temperature to melting temperature, or reduced glass transition temperature, Trg, of more than about 0.5, preferably more than about 0.55, and most preferably more than about 0.6, is provided, where the composition is of the bulk-solidifying amorphous alloy is given by M1*a*M2*b*M3*c*, etc., where the subscripts a, b, c, etc. denote the atomic percentages of the respective metal components M1, M2, M3, etc.

Figure 2:
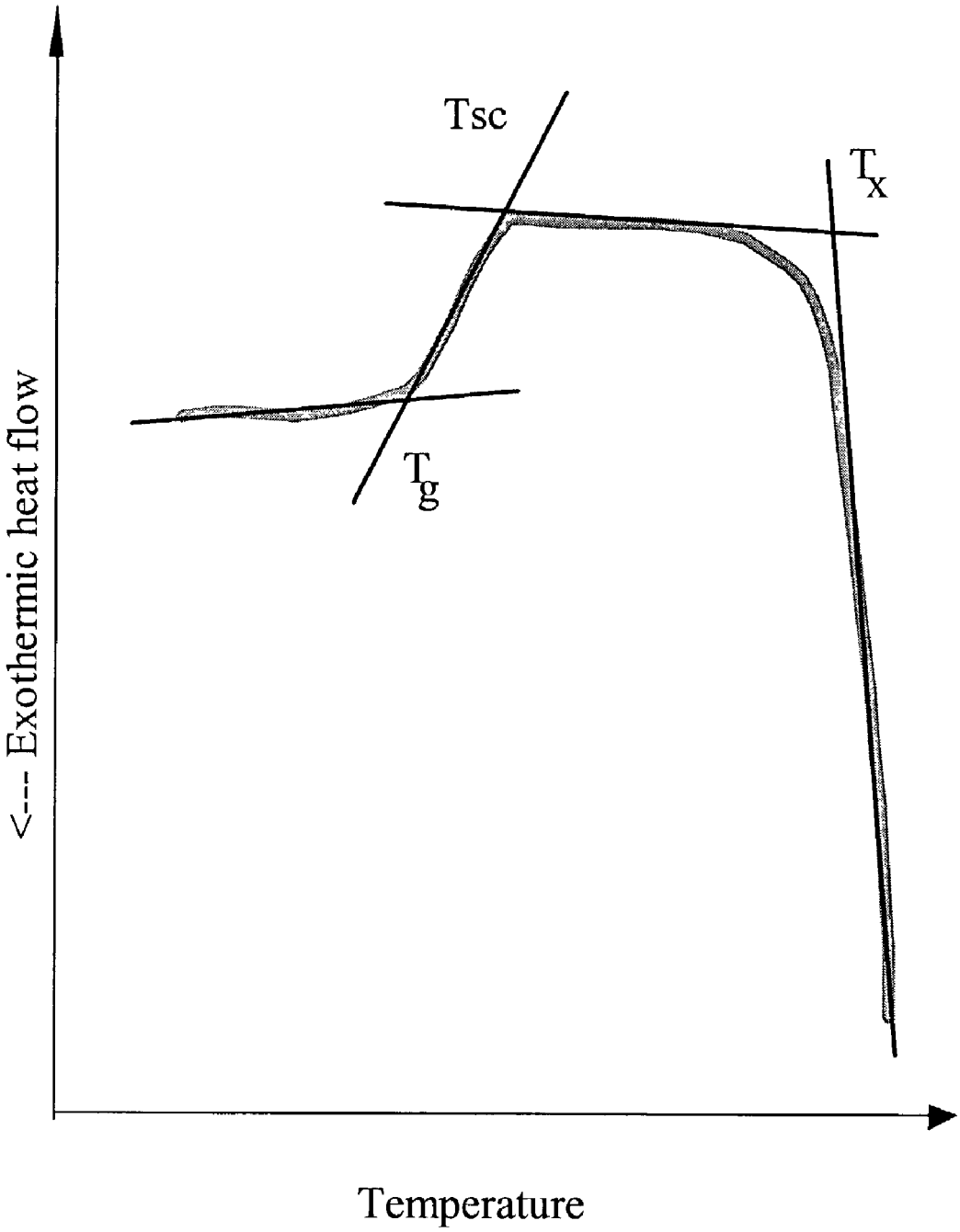
FIG. 2, is a graphical representation of the physical properties of the bulk-solidifying amorphous alloys according to the present invention.

In the above discussion it is to be understood that Tg is determined from standard DSC (Differential Scanning Calorimetry) scans at 20° C./min as shown in FIG. 2. Tg is defined as the onset temperature of glass transition.

Then, in a Step 2, the H(M) (absolute value of "heat of formation" per one oxygen atom for the most stable metal oxide of metal component M) of each metal component is identified where "the most stable metal oxide" is the metal oxide (MxOy) having the largest absolute value of the heat of formation per one oxygen atom among the competing oxide states of the metal component M. In such an embodiment, the temperature of interest in identifying the H(M) is the liquidus temperature of the alloy composition C.

Although only a single metal oxide is discussed above, the basic unit of the metal oxide (MyOz) may contain more than one oxygen atom. Accordingly, to find the heat of formation per one oxygen atom, H(M), the heat of formation of that basic unit is divided by the number of oxygen atoms in this basic unit. In this step it is also possible to identify the H(C) max, where H(C)max is the largest H(M) among the metal components of amorphous alloy C(M1*a*, M2*b*, M3*c* . . . ). It will be recognized that the heats of formation for the metal oxides can be easily found in various sources including "Handbook of Physics and Chemistry".

In step 3, as shown in FIG. 1, an "alloying metal" (Q), different than the elemental metal components of M1, M2, M3 . . . , is identified using the following inequality:

$$H(Q) > H(C)\max \tag{1}$$

Then metal Q is then added to the bulk-solidifying amorphous alloy composition C, to form a new improved bulk-solidifying amorphous alloy: (M1*a*, M2*b*, M3*c* . . . )100−x Qx subject to the following equation:

$$x = k * C(O), \tag{2}$$

where k is a constant having a range from about 0.5 to 10, a preferred range of from about 0.5 to 1, another preferred range of from about 3 to 5, yet another preferred range of from about 5 to 10, and a more preferred range of from about 1 to 3; x defines the atomic percentage of the "alloying metal" Q in the new alloy; and C(O) defines the expected atomic percentage of oxygen in the as-cast article of the bulk solidifying amorphous alloy "C". Although not to be bound by theory, oxygen is expected to exist as an incidental impurity where its source can be from raw materials and processing environment including melting crucibles.

Although any bulk-solidifying amorphous alloy composition meeting the inventive requirements may be utilized, a preferred family of bulk-solidifying amorphous alloys are the Zr—Ti based alloys. Such alloy compositions have been disclosed in U.S. Pat. Nos. 5,032,196; 5,288,344; 5,368,659; 5,618,359; and 5,735,975, the disclosures of which are incorporated herein by reference. The term "Zr—Ti based" for the purposes of the current invention is understood as incorporating those bulk-solidifying amorphous alloy compositions wherein the total of Zr and Ti comprises the largest atomic percentage of metal components in the subject alloy composition. Still more preferred are Zr and Ti-base alloy compositions in which H(Zr) is within 5% of H(C)max. Another family of preferred bulk-solidifying amorphous alloys is Zr and Ti-base alloy compositions in which H(Zr) is the largest H(M) among the "major constituents" of the subject alloy composition and wherein the major constituents are understood as having atomic percentages of more than 5%.

Again although any alloy metal having suitable properties may be utilized in the current invention, the elements La, Y, Ca, Al, and Be are preferred "alloying metals" as Q, and still more preferred is Y(Yttrium). Although only single component alloying metals are described above, in another embodiment of the invention, one or more alloying metals Q are employed in combination as the alloying metal, Q.

Herein, it should be understood that, the above steps does not necessarily describe the actual "physical" alloy making process, but rather identify the new improved alloy composition. Once the composition is identified, the "physical" alloy can be prepared in a variety of ways. In a typical alloy making process, all the input raw material can be blended and then heated up into the fusion temperature. In another way, the alloying can be carried out in steps, wherein in each step two or more elements (but not all elements) can be blended and fused together until the very last step, where all elements are fused.

The invention is also directed to methods of making feedstocks of the improved bulk-solifiying amorphous alloy compositions. Accordingly, in Step 4, after the new improved bulk-solidifying amorphous alloy composition is prepared by the addition of Q, it is preferably subjected to a heat treatment.

One embodiment of a suitable heat treatment, preferred for the maximum effectiveness of the alloying metal Q is to heat the alloy composition a temperature according to the following equation:

$$T_{heat} = T_m(C) + 200°\ \text{C}. \tag{3}$$

where $T_{heat}$ is the superheating temperature and $T_m$ is the melting temperature of the alloy composition. Accordingly, in such an embodiment, after the metal Q is added, the new alloy (M1*a*, M2*b*, M3*c* . . . )100−x Qx is super-heated above the melting temperature of the alloy C. Herein, the melting temperature is understood as the liquidus temperature of C. The superheat is in the range of from about 100° C. to 300° C. or more above the melting temperature, preferably around 200° C., or alternatively preferably around 300° C. or more.

The dwell time during the superheat is in the range of from about 1 minutes to 60 minutes, a preferable dwell time is from about 5 minutes to 10 minutes, another preferable dwell time is from about 1 minutes to 5 minutes, and yet another preferable dwell time is from about 10 minutes to 30 minutes. Dwell time is specified generally with respect to the superheat employed. The higher the superheat, the less dwell is needed. The purpose of this heat treatment is to provide oxygen atoms (whether in solution or oxide) sufficient time and thermal agitation to sample the atomic species of the alloying metal. Accordingly, any oxide of base metal, such as from the raw materials, can be broken by the higher heat of formation of the alloying metal. Furthermore, the dwell time can be reduced by utilizing some stirring action as in the case of induction melting or electromagnetic stirring, rather than static melting.

This invention is also directed to methods of casting the improved alloy compositions of the current invention. In such an embodiment, subsequent to the heat treatment, as shown in Step 5, the new alloy composition is cast into the desired shape. A preferred casting method is metal mold casting such as high-pressure die-casting. Regardless of the method of casting chosen, the casting is preferably carried out under an inert atmosphere or in a vacuum.

As discussed above, it is known in prior art (such as U.S. Pat. No. 5,797,443), that the increase of critical cooling rate with increasing oxygen content limits the processability of bulk-solidifying amorphous alloys to an extent that these alloys can not be processed into bulk (thickness of 1.0 mm or more) with an oxygen content above a certain level. For example, non-Be Zr-based alloys typically can not be readily processed into a bulk form with an oxygen content exceeding 1,000 ppm. For section thickness of several mm or more, the oxygen content should generally be limited to 500 ppm or less in the case of these non-Be Zr-based alloys. Similar relations have also been observed for Be containing Zr—Ti based alloys, although the tolerable oxygen content has been found to be higher than in the non-Be alloys. Similar trends have also been expected in other families of alloys, such as ferrous-base (Fe, Ni, Co, Cu) bulk amorphous alloys, where the tolerable oxygen content is much lower than in the above cases.

Accordingly, the spirit of the invention can be applied in several forms. In one form, raw materials with higher impurities can be utilized. For example, typical Zr and Ti elemental "sponge", which is used as the raw material for Zr and Ti based alloys, has an oxygen content of 500 ppm or more, whereas typical Zr and Ti elemental xtal-bar, a more expensive version of input raw material, has an oxygen content of 200 ppm or less. Considering the additional impurities incidentally picked-up during processing, such as alloying, re-melting, and casting, the oxygen content can easily exceed 1,000 ppm when the elemental "sponge" material is used as the input raw material. At this level of contamination, a typical non-Be Zr-based alloy can no longer function as a "bulk-solidifying" amorphous alloy. In order to preserve the ability to form the bulk amorphous phase, either a more expensive elemental "xtal-bar" or a costly control of the processing environment is typically utilized. It has been discovered that by utilizing the materials of the current invention, such a constraint, i.e., the use of more expensive raw materials or costly control of the processing environment, can be avoided.

In another embodiment, the invention can be utilized to process articles having larger cross-sections than possible with the base composition of conventional bulk-solidifying amorphous alloys. For example, using stringent processing environment and the best quality raw materials, such as xtal bar, a typical non-Be Zr-based amorphous alloy can only be cast into a bulk shape with a 5 mm cross-section. Again, it has been discovered that by utilizing the materials of the current invention, the bulk-solidifying amorphous alloys can be cast into articles having bulk shapes with cross-sections of 7 mm or more.

Although the above discussion has only focussed on utilizing the materials of the current invention for either reducing the need for high purity raw materials or for producing articles having larger cross-sectional dimensions, it should also be understood that a combination of the above mentioned embodiments can be utilized. For example, in one embodiment a suitable set of input raw material and processing environment can be selected such that it is possible to process the chosen bulk-solidifying amorphous alloy into a bulk shape of specific cross-section. Still in another embodiment, scrap recycling can be utilized with the benefit of current invention as well.

Finally, as a result of the improved properties of the alloy compositions of the current invention, these materials may be cast at lower cooling rates then are possible with the original bulk-solidifying amorphous alloy C(M1*a,* M2*b*, M3*c* . . . ).

In any of the above embodiments, the cast articles of the new improved bulk-solidifying amorphous alloys should preferrably have an elastic limit of at least 1.2%, and more preferably an elastic limit of at least 1.8%, and most preferably an elastic limit of at least of 1.8% plus a bend ductility of at least 1.0%.

Figure 3:
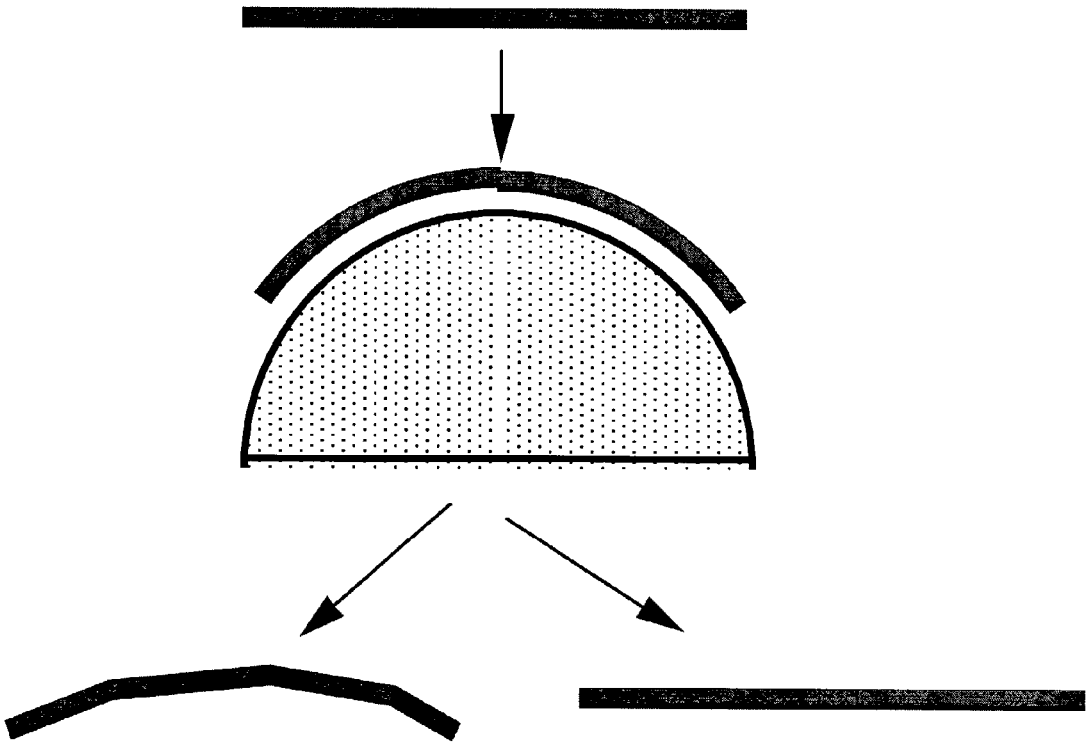
FIG. 3, is a schematic of a method of determining the elastic limit of a molded article according to the present invention.

The elastic limit of a material is defined as the maximum level of strain beyond which permanent deformation or breakage sets in. The elastic limit of an item can be measured by a variety of mechanical tests such as the uni-axial tension test. However, this test may not be very practical. A relatively practical test is the bending test, shown schematically in FIG. 3, in which a cut strip of amorphous alloy, such as one with a thickness of 0.5 mm, is bent around mandrels of varying diameter. After, the bending is complete, and the sample strip is released without any breakage, the sample is said to stay elastic if no permanent bend is visibly observed. If a permanent bent can be visibly seen, the sample is said to have exceeded its elastic limit strain. For a thin strip relative to the diameter of mandrel, the strain in this bending test is very closely given by ratio of thickness of strip (t) and diameter of mandrel (D), e=t/D.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A bulk-solidifying amorphous alloy comprising:

a base bulk solidifying amorphous alloy including a plurality of metal components each having a separate heat of formation for oxygen; and an additional alloying metal having an alloying metal heat of formation for oxygen, where the alloying metal heat of formation for oxygen is greater than the largest heat of formation for oxygen among the metal components;

wherein the bulk-solidifying amorphous alloy is defined by the molecular equation:

$$(M1aM2b \ldots Mnc)100-x\ Qx$$

and is subject to the following equation when cast:

$$x=k*C(O),$$

where M1, M2, and M3 are the metal components in the base alloy; n is the number of metal components in the base alloy; a, b, and c define the atomic percentage of the metal components in the base alloy; Q is the additional alloying metal; x defines the atomic percentage of the additional alloying metal in the bulk-solidifying amorphous alloy; k is a constant having a range from about 0.5 to 10; and C(O) defines the atomic percentage of oxygen in an as-cast article of the bulk-solidifying amorphous alloy.

2. The bulk-solidifying amorphous alloy of claim 1, wherein the base bulk solidifying amorphous alloy is Zr—Ti based.

3. The bulk-solidifying amorphous alloy of claim 2, wherein the total of Zr and Ti comprises the largest atomic percentage of the metal components in the base alloy.

4. The bulk-solidifying amorphous alloy of claim 2, wherein the heat of formation for oxygen of Zr is within 5% of the largest metal component heat of formation for oxygen.

5. The bulk-solidifying amorphous alloy of claim 2, wherein the heat of formation for oxygen for Zr is the largest among the metal component heats of formation for oxygen chosen from the group of metal components of the base alloy comprising more than 5 atomic percentage of the base alloy.

6. The bulk-solidifying amorphous alloy of claim 1, wherein the additional alloying metal is selected from the group consisting of La, Y, Ca, Al, and Be.

7. The cast article of claim 1, wherein k has a range of from about 0.5 to 1.

8. The cast article of claim 1, wherein k has a range of from about 3 to 5.

9. The cast article of claim 1, wherein k has a range of from about 5 to 10.

10. The cast article of claim 1, wherein k has a range of fmm about 1 to 3.

11. The bulk-solidifying amorphous alloy of claim 1, wherein the oxygen content is more than 200 ppm.

12. The bulk-solidifying amorphous alloy of claim 1, wherein the oxygen content is more than 500 ppm.

13. The bulk-solidifying amorphous alloy of claim 1, wherein the oxygen content is more than 1,000 ppm.

14. The bulk-solidifying amorphous alloy of claim 1, wherein the base alloy has a ratio of glass transition temperature to melting temperature, Trg, of more than about 0.5.

15. The bulk-solidifying amorphous alloy of claim 1, wherein the base alloy has a ratio of glass transition temperature to melting temperature, Trg, of more than about 0.55.

16. The bulk-solidifying amorphous alloy of claim 1, wherein the base alloy has a ratio of glass transition temperature to melting temperature, Trg, of more than about 0.6.

17. A cast article comprising at least one cast piece made from the bulk-solidifying amorphous alloy of claim 1.

18. The cast article of claim 17, wherein the article has an elastic limit of at least 1.2%.

19. The cast article of claim 17, wherein the article has an elastic limit of at least 1.5%.

20. The cast article of claim 17, wherein the article has an elastic limit of at least 1.8% plus a bend ductility of at least 1.0%.

21. The cast article of claim 17, wherein the base bulk solidifying amorphous alloy is Zr—Ti based.

22. The cast article of claim 21, wherein the article has an oxygen content of more than 200 ppm.

23. The cast article of claim 21, wherein the article has an oxygen content of more than 500 ppm.

24. The cast article of claim 21, wherein the article has an oxygen content of more than 1,000 ppm.

25. A feedstock blank comprising at least one piece made from the bulk-solidifying amorphous alloy of claim 1.

26. The feedstock blank of claim 25, wherein the base bulk solidifying amorphous alloy is Zr—Ti based.

27. The feedstock blank of claim 26, wherein the blank has an oxygen content of more than 200 ppm.

28. The feedstock blank of claim 26, wherein the blank has an oxygen content of more than 500 ppm.

29. The feedstook blank of claim 26, wherein the blank has an oxygen content of more than 1,000 ppm.

30. A method of forming a bulk-solidifying amorphous alloy comprising the steps of:

providing a base bulk-solidifying amorphous alloy including a plurality of metal components each having a separate heat of formation for oxygen;

providing an additional alloying metal having an alloying metal heat of formation for oxygen, where the alloying metal heat of formation for oxygen is greater than the largest heat of formation for oxygen among the metal components; and adding the additional alloying metal to the base alloy to form a new the bulk-solidifying amorphous alloy;

wherein the bulk-solidifying amorphous alloy is defined by the molecular equation:

$$(M1aM2b \ldots Mnc)100-x\ Qx$$

and is subject to the following equation when cast:

$$x=k*C(O),$$

where M1, M2, and M3 are the metal components in the base alloy; n is the number of metal components in the base alloy; a, b, and c define the atomic percentage of the metal components in the base alloy; Q is the additional alloying metal; x defines the atomic percentage of the additional alloying metal in the bulk-solidifying amorphous alloy; k is a constant having a range from about 0.5 to 10; and C(O) defines the atomic percentage of oxygen in an as-cast article of the bulk-solidifying amorphous alloy.

31. The method of claim 30, wherein the base alloy is Zr—Ti based.

32. The method of claim 31, wherein the total of Zr and Ti comprises the largest atomic percentage of the metal components in the bulk-solidifying amorphous alloy.

33. The method of claim 31, wherein the heat of formation of Zr is within 5% of the largest metal component heat of formation for oxygen.

34. The method of claim 31, wherein the heat of formation of Zr is the largest among the metal component heats of formation for oxygen chosen from the group of metal components of the base alloy comprising more than 5 atomic percentage of the base alloy.

35. The method of claim 30, wherein the additional alloying metal is selected from the group consisting of La, Y, Ca, Al, and B.

36. The method of claim 30, wherein k has a range of from about 0.5 to 1.

37. The method of claim 30, wherein k has a range of from about 3 to 5.

38. The method of claim 30, wherein k has a range of from about 5 to 10.

39. The method of claim 30, wherein k has a range of from about 1 to 3.

40. The method of claim 30, wherein the base alloy has a ratio of glass transition temperature to melting temperature, Trg, of more than about 0.5.

41. The method of claim 30, wherein the base alloy has a ratio of glass transition temperature to melting temperature, Trg, of more than about 0.55.

42. The method of claim 30, wherein the base alloy has a ratio of glass transition temperature to melting temperature, Trg, of more than about 0.6.

43. The method of claim 30, wherein the step of providing the additional alloying metal comprises adding the additional alloying metal into a feedstock of the base alloy.

44. The method of claim 30, further comprising the step of superheating the bulk-solidifying amorphous alloy comprising heating the bulk-solidifying amorphous alloy to a superheating temperature.

45. The method of claim 44, wherein the step of superheating is conducted at a superheating temperature according to the equation: $T_{heat}=T_m(C)+200°$ C., where $T_{heat}$ is the superheating temperature and $T_m$ is the melting temperature of the bulk-solidifying amorphous alloy.

46. The method of claim 44, wherein the step of superheating is conducted at a temperature in the range of from about 100° C. to 300° C. or more above the melting temperature of the bulk-solidifying amorphous alloy.

47. The method of claim 44, wherein the step of superheating is conducted at a temperature in the range of from about 300° C. or more above the melting temperature of the bulk-solidifying amorphous alloy.

48. The method of claim 44, wherein the step of superheating further comprises maintaining the superheating temperature for a specified dwell time in the range of from about 1 minute to 60 minutes.

49. The method of claim 44, wherein the step of superheating further comprises maintaining the superheating temperature for a specified dwell time in the range of from about 5 minutes to 10 minutes.

50. The method of claim 44, wherein the step of superheating further comprises maintaining the superheating temperature for a specified dwell time in the range of from about 1 minute to 5 minutes.

51. The method of claim 44, wherein the step of superheating further comprises maintaining the superheating temperature for a specified dwell time in the range of from about 10 minutes to 30 minutes.

52. A method of forming a feedstock of bulk-solidifying amorphous alloy comprising the steps of:

providing a base alloy including a plurality of metal components each having a separate heat of formation for oxygen; and providing an additional alloying metal having an alloying metal heat of formation for oxygen, where the alloying metal heat of formation for oxygen is greater than the largest heat of formation for oxygen among the metal components;

adding the additional alloying metal to the base alloy to form the bulk-solidifying amorphous alloy; and superheating the bulk-solidifying amorphous alloy comprising heating the bulk-solidifying amorphous alloy to a superheating temperature;

wherein the bulk-solidifying amorphous alloy is defined by the molecular equation:

$$(M1aM2b \ldots Mnc)100-x\ Qx$$

and is subject to the following equation when cast:

$$x=k*C(O),$$

where M1, M2, and M3 are the metal components in the base alloy; n is the number of metal components in the base alloy; a, b, and c define the atomic percentage of the metal components in the base alloy; Q is the additional alloying metal; x defines the atomic percentage of the additional alloying metal in the bulk-solidifying amorphous alloy; k is a constant having a range from about 0.5 to 10; and C(O) defines the atomic percentage of oxygen in an as-cast article of the bulk-solidifying amorphous alloy.

53. The method of claim 52, wherein the step of providing the additional alloying metal comprises adding the additional alloying metal into a feedstock of the base alloy.

54. A method of casting amorphous articles comprising the steps of:

providing a base alloy including a plurality of metal components each having a separate heat of formation for oxygen; and providing an additional alloying metal having an alloying metal heat of formation for oxygen, where the alloying metal heat of formation for oxygen is greater than the largest heat of formation for oxygen among the metal components;

adding the additional alloying metal to the base alloy to form the bulk-solidifying amorphous alloy;

superheating the bulk-solidifying amorphous alloy comprising heating the bulk-solidifying amorphous alloy to a superheating temperature; and casting the bulk-solidifying amorphous alloy into a finished article at a cooling rate such that the finished article remains substantially amorphous;

wherein the bulk-solidifying amorphous alloy is defined by the molecular equation:

$$(M1aM2b \ldots Mnc)100-x\ Qx$$

and is subject to the following equation when cast:

$$x=k*C(O),$$

where M1, M2, and M3 are the metal components in the base alloy; n is the number of metal components in the base alloy; a, b, and c define the atomic percentage of the metal components in the base alloy; Q is the additional alloy in metal; x defines the atomic percentage of the additional alloying metal in the bulk-solidifying amorphous alloy; k is a constant having a range from about 0.5 to 10; and C(O) defines the atomic percentage of oxygen in an as-cast article of the bulk-solidifying amorphous alloy.

55. The method of claim 54, wherein the step of providing the additional alloying metal comprises adding the additional alloying metal into a feedstock of the base alloy.

56. The method of claim 54, wherein the step of casting occurs at a cooling rate less than the cooling rate required for the base alloy to ensure that the base alloy remains substantially amorphous.

57. The method of claim 54, wherein the base alloy has a ratio of glass transition temperature to melting temperature, Trg, of more than about 0.55.

58. The method of claim 54, wherein the base alloy has a ratio of glass transition temperature to melting temperature, Trg, of more than about 0.6.

59. The method amorphous alloy of claim 54, wherein the base bulk solidifying amorphous alloy is Zr—Ti based.

60. The method amorphous alloy of claim 54, wherein the additional alloying metal is selected from the group consisting of La, Y, Ca, Al, and Be.

61. The method of claim 54, wherein the step of casting utilizes a method of high-pressure die-casting.

62. The method of claim 54, wherein the step of casting is carried out under inert atmosphere or vacuum.

63. The method of claim 54, wherein the finished article has an elastic limit of at least 1.2%.

64. The method of claim 54, wherein the finished article has an elastic limit of at least 1.8%.

65. The method of claim 54, wherein the finished article has an elastic limit of at least 1.8% plus a bend ductility of at least 1.0%.

66. The method of claim 54, further comprising the step of testing the elastic limit of the finished article.

67. The method of claim 66, wherein the step of testing comprises bend testing the finished article.

* * * * *